United States Patent [19]

Merenda et al.

[11] 3,975,659

[45] Aug. 17, 1976

[54] LAMP WITH AN INTEGRATED FLASHER DEVICE

[75] Inventors: Pierre Merenda; Jean Claude Reymond, both of Paris, France

[73] Assignee: Thomson-CSF, Paris, France

[22] Filed: Mar. 12, 1975

[21] Appl. No.: 557,783

[30] Foreign Application Priority Data

Mar. 15, 1974 France ..... 74.08882

[52] U.S. Cl. ..... 315/72; 315/73

[51] Int. Cl.[2] ..... H01J 19/78

[58] Field of Search ..... 315/72, 73, 74, 51, 315/52, 53

[56] References Cited

UNITED STATES PATENTS

| | | | |
|---|---|---|---|
| 2,110,690 | 3/1938 | Zierahn | 315/51 |
| 3,458,756 | 7/1969 | Kotsch | 315/72 X |

*Primary Examiner*—R. V. Rolinec
*Assistant Examiner*—Darwin R. Hostetter
*Attorney, Agent, or Firm*—Cushman, Darby & Cushman

[57] ABSTRACT

A lamp for installation in the flashers or winkers of motor vehicles, with a flasher device integrated into the lamp itself, is provided. The flashing is produced, in the case of the invention, by the utilization of substances which exhibit a sudden change in resistivity at a certain temperature. This is the case with powdered $V\ O_2$ when formed into an aglomerate by the use of an organic binder. A block assembled in the bulb of the lamp and in electrical parallel with the filament, does not effect the incandescent state of the latter as long as a temperature of 68° C is not exceeded, but effectively short-circuits the filament beyond this temperature. In this fashion, successive extinctions and relightings take place by a process of relaxation. In the case of a $C_{36}H_{74}$ wax filled with conductive powder, the phenomena are reversed and the block must be connected in series with the filament.

4 Claims, 6 Drawing Figures

LAMP WITH AN INTEGRATED FLASHER DEVICE

The present invention relates to a lamp with an integrated flasher device. It relates in particular to flasher lamps of the kind fitted to motor vehicles, which lamps are now a statutary requirement on such vehicles, for instance as direction indicators.

Those skilled in the art will be aware that the flashing action is produced by an automatic device of the "relaxation oscillator" type. This kind of device has not hitherto been integrated into the lamp in the manner which would be desirable in order to simplify the setting up of the flasher device.

The invention makes it possible to fulfil this desire by having recourse to certain substances which present the property of suddenly changing their electrical resistivity at a certain temperature.

According to the present invention, there is provided a lamp with an integrated flasher device, comprising a block of material which, as a function of temperature, exhibits at least one reversible transition in its resistivity, said block being arranged in order to receive part of the heat flow emitted by said lamp and being connected in the electrical supply circuit of the lamp in such a fashion that a first change in resistivity causes the supply current to drop sharply, the current being normally re-established during a second change in resistivity which is the reverse of the first.

The invention will be better understood and other of its features rendered apparent from a consideration of the ensuing description and the accompanying drawings in which:

FIGS. 1 and 6 are explanatory graphs;

FIGS. 2 and 5 schematically illustrate a sectional view of embodiments of lamps in accordance with the invention;

Figure 1:
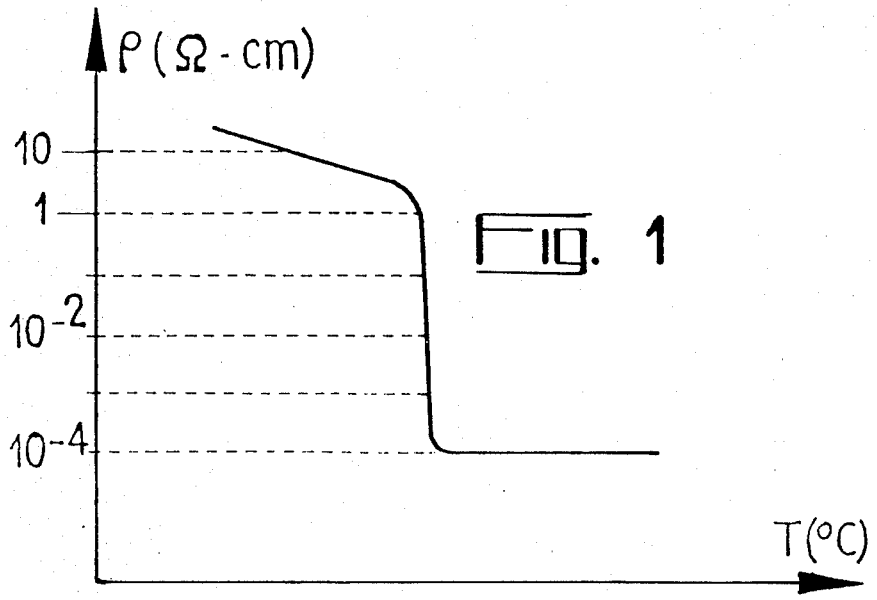

A first category of substances is constituted by elements which undergo a phase transformation either of crystalographic nature accompanied by electron transitions, or of purely electronic nature. Vanadium dioxide $V O_2$, which belongs to this category, has the properties of a semi-conductor at ambient temperature and those of a metallic conductor beyond 68° C. Thus, over a temperature range of some few tens of degrees, it changes from a resistivity of around 10 ohm-cm to a resistivity of the order of $10^{-4}$ ohm-cm. In FIG. 1, there has been plotted a graph which indicates as a function of temperature in degrees C, the profile of the measured resistivity, in accordance with a logarithmic scale plotted on the ordinates. Frequently, and in particular with $V O_2$, it is preferred to utilise the substance in the form of a very fine powder (grains of the order of one micron in size) embedded in a plastic material which is used as binder. The material thus obtained exhibits a change in resistivity which remains extremely large and highly reproducible, no hysteresis phenomena being encountered. Moreover, it is easy to machine and it is a simple matter to obtain the shape required for the particular application.

A second category of substances is constituted by materials which exhibit a sudden change in coefficient of expansion at a certain temperature, due to a phase transformation. These materials are loaded with powdered metals or carbon, having grain sizes of the order of one micron, with a sufficient density for the grains to be in contact with one another at ambient temperature, this producing a low resistivity on the part of the material thus created. At the instant at which phase transformation occurs, the substantial expansion which occurs results in the moving apart of the grains and the substance becomes a semi-insulator. This is the case, for example, with a hydrocarbon wax of the general formula $C_{36}H_{74}$, whose melting point is around 73° C, and at this temperature an expansion of the order of 22 % occurs. The proportion of conductive powder in the material is of the order of 6 to 10 % and the preparation of the substance requires dispersion of the filler by means of an ultrasonic process.

The substances of both categories, for example $V O_2$ and $C_{36}H_{74}$, can be combined in order to produce a material which experiences two successive changes in resistivity, which changes are the reverse of one another.

In a first embodiment of the invention (FIG. 2), the properties of $V O_2$ alone, are utilised. An incandescente lamp of the rare gas type is employed in order to prevent evaporation of the binder which supplements the grains of $V O_2$ in order to form a block of material 1 whose resistance above 68° C should be negligible in relation to that of the filament, this constituting a basic condition.

During the manufacture of the lamp, the block 1 is assembled in such a way that the conductors 21 and 22 carrying the filament 2 of the lamp 20, pass through the block at the two ends thereof. A resistor 3, arranged in series in the conductor 21, is located in the base 200 of the lamp and embedded in an electrically insulating substance which, however, has good thermal conductivity, for example beryllium oxide. It will be seen, hereafter, that the resistor 3 should have a thermal dissipation factor of the same order as that of the filament.

Figure 3:
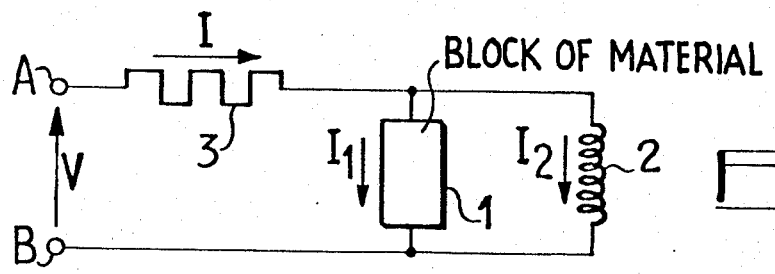
FIG. 3 is an equivalent electrical diagram of the lamp shown in FIG. 2.

In the equivalent electrical diagram of FIG. 3, a supply voltage V between the terminals A and B (the contacts of the lamp base), causes a current I to flow in the resistor 3, this splitting into a current $I_1$ in the material 1 and a current $I_2$ in the filament 2. There are therefore two possible states:

a. The low conductivity state of the material 1 (in the cold condition).

$$I_2 >> I_1$$

b. The high conductivity state of the material 1 in the hot condition (negligible resistance compared with that of the filament, in accordance with the basic condition).

$$I_2 << I_1$$

The resistor 3 has a resistance of the same order as that of the filament 2; in other words, it is desirable that the power taken from the electrical supply should be of the same order during the phases corresponding to the states (a) and (b).

Figure 4:
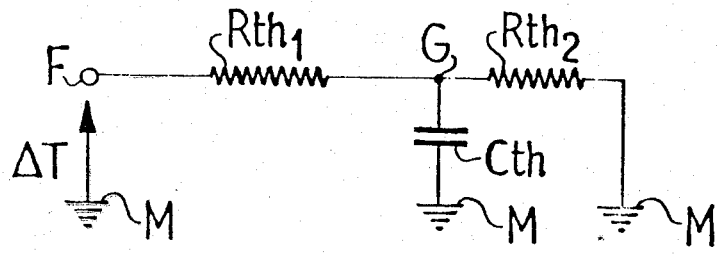
FIG. 4 is an equivalent heat-flow chart of the lamp shown in FIG. 2.

In order for the lamp to flash at the desired rate, it is necessary to satisfy certain conditions which the heat flow chart of FIG. 4 will help to clarify.

From the thermal point of view, three elements have to be considered, each having a substantially constant temperature throughout its own mass:

the filament (point F in FIG. 4);

the material 1 (point G and thermal capacitor Cth);

the mass M of the base, of the sleeve and for instance of the bodywork of the vehicle, considered as an infinite capacitance.

Between these elements there have been illustrated resistances and a thermal capacitance, all in accordance with the wellknown rules of electrical analogy. The thermal resistances $Rth_1$ and $Rth_2$ are drawn as electrical resistances between the elements F and G on the one hand and G and M on the other. Between F and M there is no direct thermal coupling (neglecting the losses to the atmosphere and the glass of the bulb). Between G and M, there is a thermal capacitance Cth. The calorific capacitance of the filament has been neglected.

During the phase (a), the filament being in the incandescent state, the temperature difference $\Delta T$ between F and M is high and the temperature of the element G rises in accordance with a curve similar to that of the voltage on a capacitor connected in the manner shown in FIG. 4 during the phase of charging. Those skilled in the art will appreciate that the time constant of the phenomenon is given by the formula:

$$k = \frac{Rth_1 \times Rth_2}{Rth_1 + Rth_2} Cth$$

During the phase (b), the filament is not incandescent and the temperature of the element G drops, in other words the capacitance discharges to earth across the thermal resistances, with the same time constant as that referred to above.

The calculation of this time constant furnishes one of the parameters governing the observed relaxation oscillation. Other parameters, such as the power of the supply (therefore its voltage) and the absolute value of $Rth_1$, are involved in determining the flashing periodicity.

Figure 5:
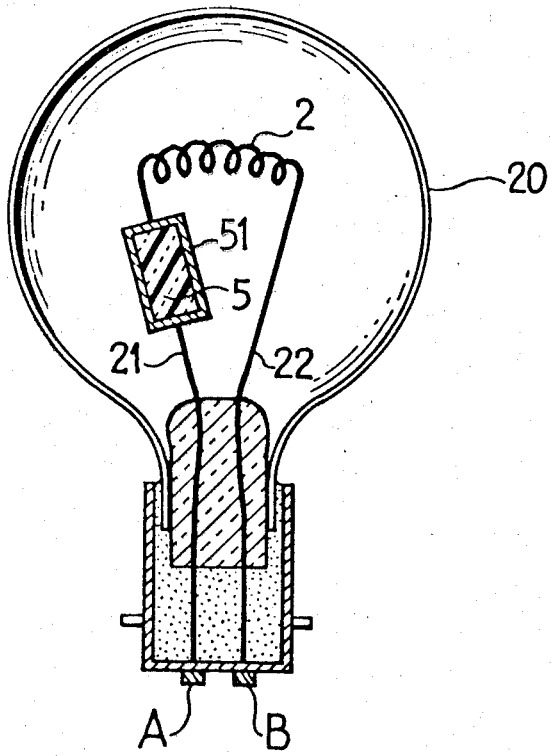

In a first variant embodiment of the invention, shown in FIG. 5, a substance from the second category is used to constitute a block 5 which is connected in series in the supply, for example by interrupting the conductor 21. The block 5 is for example constituted by the $C_{36}H_{74}$ wax filled with a conductive powder and mechanically stabilised by the use of polyisobutylene in order to prevent unwanted softening at the operating temperature; if the stabilising effect is insufficient, for example in the case of very high power lamps, then the block will be housed in a high melting point casing 51, which has good electrical insulation characteristics and adequate thermal conductivity. Operation is as follows: since the block conducts in the cold state, the series filament is supplied and becomes incandescent as a consequence of which, due to heating of the block 5, the latter changes to the insulating and interrupts the supply to the filament. After cooling of the block 5 during the phase in which the lamp is extinguished, the conductive state is regained and the cycle starts again.

The heat flow chart is similar to that of FIG. 4, the thermal resistance $Rth_2$ however, being lower than that encountered in the first solution, which may lead to the use of a conductor 21 of larger cross-sectional area in order to facilitate cooling of the block 5 and reduce the flashing periodicity.

Figure 2:
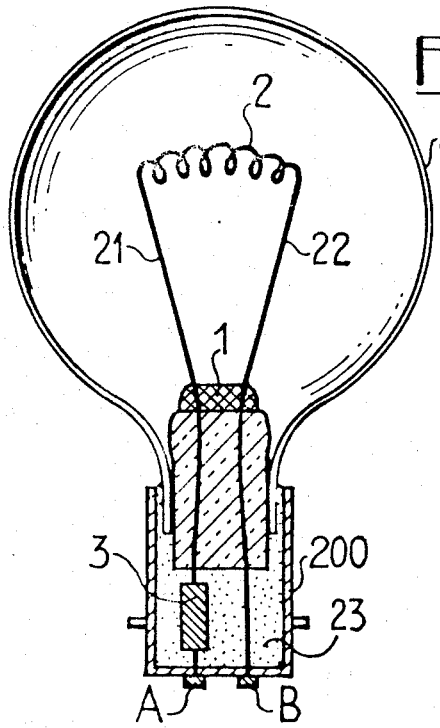

In a second variant embodiment, the arrangement of FIG. 2 is reverted to but the block 1 comprises a mixture of substances from both the categories, being constituted for example by $V\ O_2$ powder formed into an aglomerate with the help of $C_{36}H_{74}$.

Figure 6:
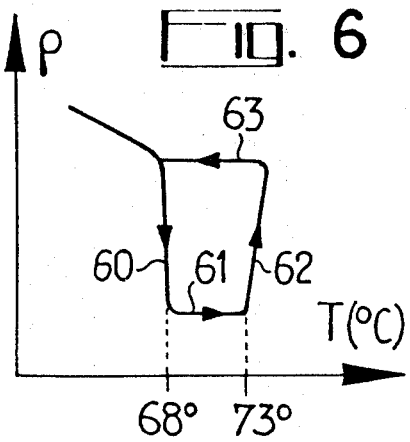

In this case, the kind of operating cycle shown in FIG. 6 is obtained. On passing beyond the temperature of 68° C, in the rising sense, the resistivity decreases in accordance with the branch 60 of the curve, (similar to the curve of FIG. 1) on account of $V\ O_2$. Then the resistivity remains very low in accordance with the branch 61 up to the temperature of 73° C when the resistivity abruptly rises in accordance with the branch 62, bringing about extension of the filament and cooling of the material in accordance with the step 63 which closes the cycle of operation of the lamp.

Self-evidently, the scope of the invention includes any embodiment utilising a substance which exhibits a change in resistivity as a function of temperature and which, without being included inside the bulb proper, is disposed in such a fashion as to receive part of the heat flow of the lamp.

Such a substance can be an antimony-doped, copper-doped or iron-doped $Ba\ Ti\ O_3$ ceramic.

The invention is applicable to any kind of signalling function involving flashing, in particular for advertising devices.

What we claim are:

1. An incandescent lamp with an inner flasher device, comprising:
   - a glass envelope,
   - a pair of lead-in conductors carrying a filament which is within said envelope and in series with said conductors,
   - a block of material containing vanadium dioxide connected in parallel with said filament inside said envelope, said lead-in conductors passing through said block at two spaced points,
   - a resistor connected in series with one of the lead-in conductors.

2. An incandescent lamp as claimed in claim 1, wherein said resistor is placed outside the glass envelope in the base of the lamp, and embedded in an electrically insulating substance which has a high thermal conductivity.

3. An incandescent lamp with an inner flasher device, comprising:
   - a glass envelope,
   - a pair of lead-in conductors carrying a filament which is within said envelope and connected in series with said conductors,
   - a block of material containing a wax filled with vanadium oxide grains and a conductive powder, said block being connected in series with one of the lead-in conductors.

4. An incandescent lamp as claimed in claim 3, wherein said wax is an organic body of global formula $C_{36}H_{74}$ stabilized by polyisobutylene.

* * * * *